United States Patent [19]

Yu

[11] Patent Number: 4,619,803

[45] Date of Patent: Oct. 28, 1986

[54] SELF-TEXTURING NYLON YARN SPINNING PROCESS

[75] Inventor: Jing-peir Yu, Pensacola, Fla.

[73] Assignee: Monsanto Company, St. Louis, Mo.

[21] Appl. No.: 633,313

[22] Filed: Jul. 23, 1984

[51] Int. Cl.[4] ..... B29C 47/88

[52] U.S. Cl. ..... 264/176.2; 264/171; 425/131.5; 425/378 S; 425/379 R

[58] Field of Search ..... 264/176 F, 327, 171; 425/378 R, 378 S, 379 R, 131.5

[56] References Cited

U.S. PATENT DOCUMENTS

| | | | |
|---|---|---|---|
| 3,408,277 | 10/1968 | Martin et al. | 264/168 |
| 3,659,989 | 5/1972 | Uraya et al. | 425/131.5 |
| 3,780,149 | 12/1973 | Keuchel et al. | 264/168 |
| 3,861,843 | 1/1975 | Keuchel et al. | 425/378 S |
| 3,901,636 | 8/1975 | Zink et al. | 425/378 R |
| 3,904,730 | 9/1975 | Shimizu et al. | 264/168 |
| 4,069,092 | 1/1978 | Zink et al. | 425/378 R |
| 4,080,138 | 3/1978 | Hutchinson et al. | 425/378 R |
| 4,176,150 | 11/1979 | Bromley et al. | 264/168 |
| 4,247,503 | 1/1981 | Venot et al. | 264/168 |

FOREIGN PATENT DOCUMENTS

| | | | |
|---|---|---|---|
| 0769636 | 10/1967 | Canada | 425/131.5 |
| 41-17927 | 10/1966 | Japan | 425/131.5 |
| 47-29441 | 8/1972 | Japan | 425/131.5 |
| 2003423 | 3/1979 | United Kingdom . | |

*Primary Examiner*—Donald Czaja
*Assistant Examiner*—Hubert C. Lorin
*Attorney, Agent, or Firm*—John W. Whisler

[57] ABSTRACT

A self-crimping filament is formed in high-speed spinning by joining hot and cool molten substances of a single polymer substantially at or preferably below the face of the spinneret. This increases the bulk of a yarn containing such filaments.

10 Claims, 4 Drawing Figures

SELF-TEXTURING NYLON YARN SPINNING PROCESS

The invention relates to the art of melt-spinning of nylon-66 filaments and yarns having latent bulk or crimp induced by differential quenching across the filament cross-sections during high speed spinning. More particularly, the invention relates to such melt spinning wherein the latent bulk is produced by enhanced temperature differences across the molten stream being quenched.

It is known to induce latent bulk by differential quenching across the filament cross-section at very high spinning speeds, as typified by Bromley U.S. Pat. No. 4,176,150.

It is also known in the art to divide a molten stream of a single polymer into two separate sub-streams, treat the sub-streams differently so as to modify one of the streams, then unite the sub-streams side-by-side as one or more combined streams. In some cases the treatment partially degrades the sub-stream. The resulting conjugate streams are then spun through spinneret capillaries, quenched, and wound as a spun yarn before a separate subsequent drawing operation or drawn in-line before winding. When the drawn yarn is relaxed, bulk is developed. Typical such prior disclosures are Martin U.S. Pat. No. 3,408,277, Keuchel U.S. Pat. No. 3,780,149, Keuchel U.S. Pat. No. 3,861,843, and Shimizu U.S. Pat. No. 3,904,730. These references do not appear to direct the quench air from any particular direction with respect to the molten streams.

In a somewhat similar vein, Uraya U.S. Pat. No. 3,659,989 starts with two different polymers instead of a single polymer, heats them to diffferent temperatures selected such that their melt viscosities are approximately equal, combines them side-by-side as conjugate streams, and then spins the conjugate streams through spinneret capillaries.

In each of these prior art teachings wherein conjugation of sub-streams occurs, the conjugation takes place well in advance of extrusion from the spinneret. Accordingly, there is an appreciable time period in which the temperatures of the two sub-streams can tend to equalize, and the resulting bulk is reduced.

According to the present invention, it has been discovered that the degree of bulk can be substantially increased by spinning at very high speeds and modifying the spinning process such that the temperature differences between the sub-streams are maintained at higher levels that would otherwise be possible according to the prior art disclosures. This is generally done by bringing the sub-streams together at a later point than is contemplated in the prior art, as set forth more fully below. Preferably the sub-streams do not merge within the spinneret, but do so below the face of the spinneret.

According to a first principal aspect of the invention, there is provided a process for spinning a yarn comprising a plurality of filaments having latent crimp, comprising spinning a plurality of filaments, each of the filaments being formed by generating first and second sub-streams of a molten polymer, the first sub-stream having a higher temperature than the second sub-stream; metering (pumping at constant rates) the sub-streams at given rates through separate passageways in a spinneret; the passageways being selected and arranged such that the sub-streams unite and merge side-by-side at a point below a plane 0.006 inch (0.15 mm) above the face of the spinneret to form a combined stream having a relatively cool side comprising the second sub-stream and a relatively hot side comprising the first sub-stream; directing quenching air against the combined stream from a given direction to thereby quench the combined stream into a filament; and withdrawing the filament from the combined stream at a spinning speed above 2500 MPM. The filaments are then converged at a given distance from the spinneret to form the yarn. The polymer, the temperatures of the sub-streams, the metering rates of the sub-streams, the given direction, the given distance, and the spinning speed are selected such that the yarn has an elongation below 100% and a bulk of at least 10%.

According to further aspects of the invention, the higher temperature is generated by metering the first sub-stream through a higher resistance to fluid flow than the second sub-stream prior to extrusion through the passageways. In accordance with certain preferred aspects, the passageway through which the second sub-stream is metered is preferably selected such that the second sub-stream has a non-round cross-section prior to merging with the first sub-stream. Advantageously for various end uses, the metering rates and spinning speed are selected such that the filament has a denier of at least 12. The passageways are preferably selected and arranged such that the sub-streams merge below the face of the spinneret. The given direction of the quench air is preferably selected such that the quench air preferentially impinges on the cool side if maximum bulk is desired. Preferably the yarn is composed of nylon-66 polymer, with between 0.5 and 15 mol % terephthalic acid replacing a like amount of adipic acid being particularly preferred. The resulting polymer will accordingly contain between 0.5 and 15 mol % hexamethylene diammonium terephthalate moieties.

Other aspects will in part appear hereinafter and will in part be apparent from the following detailed description taken together with the accompanying drawings, wherein.

Figure 1:
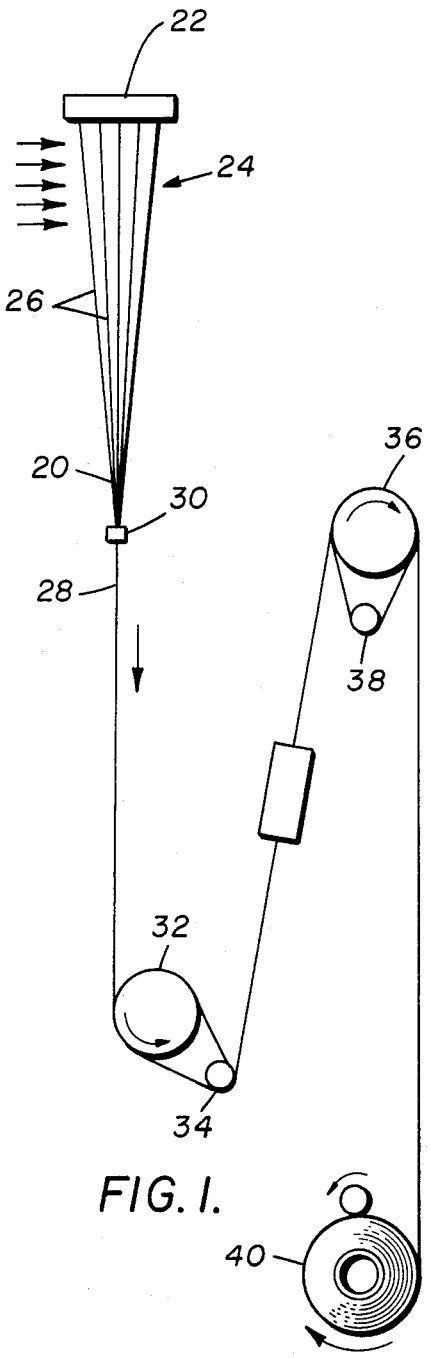
FIG. 1 is a schematic front elevation view of the preferred apparatus for practicing the process.

With reference to FIG. 1, the yarn is spun as a plurality of molten streams 24 from spinneret 22. The molten streams 24 are quenched into filaments 26 by transversely directed quenching air in a quench zone below spinneret 22. Filaments 26 are withdrawn from their corresponding molten streams and converged into yarn 28 at spin finish applicator 30 located a given distance below spinneret 22. Yarn 28 passes around feed roll 32 and its associated separator roll 34, then around delivery roll 36 and its associated separator 38 prior to being wound by winder 40. An optional tangle chamber or prebulker may be positioned between rolls 32 and 36 or may be positioned between roll 36 and winder 40. Each or all of rolls 32, 34, 36, and 38 may be eliminated according to various aspects of the invention.

In operation of the FIG. 1 apparatus, the freshly quenched filaments are withdrawn from their corresponding molten stream at a spinning speed determined by the speed of feed roll 32. Delivery roll 36 may be driven at a higher speed than feed roll 32 if desired, and preferably has a somewhat higher speed than winder 40 in order to provide the desired winding tension. If there are no rolls 32, 34, 36, or 38 provided, the spinning speed is determined by the speed of winder 40 to provide "straight through spinning".

Figure 2:
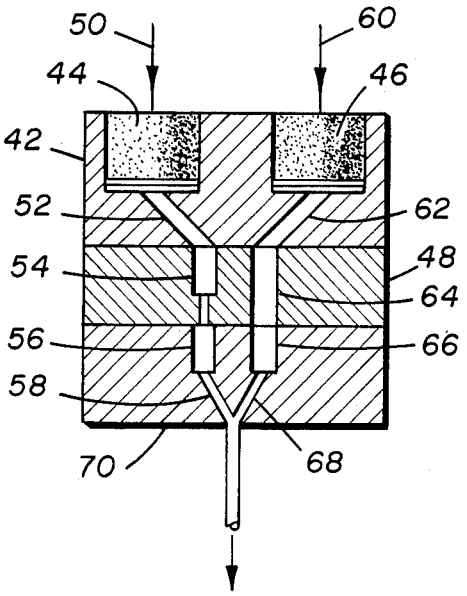
FIG. 2 is a vertical sectional view of a spinneret pack assembly according to one aspect of the invention.

FIG. 2 illustrates a preferred spinning pack design for practicing the invention. Filter block 42 has cavities 44 and 46 formed in its upper surface, each of the cavities containing sand or other filtration media. Pressure plate 48 is positioned between block 42 and spinneret 22. A first sub-stream 50 of molten polymer is metered (pumped at a constant rate) and fed into cavity 44 through the filtration media contained therein, then passes downwardly through passage 52 to passage 54 in plate 48. The first sub-stream then passes through counterbore 56 in spinneret 22, from which it passes through capillary 58. In like manner, the second separately metered sub-stream 60 is fed into cavity 46 through the filtration media contained therein, then passes downwardly through passage 62 to passage 64 in plate 48. The second sub-stream then passes through counterbore 66 in spinneret 22, after which it passes through capillary 68. Capillaries 58 and 68 together cooperate as a combined orifice in spinning a single filament. A spinneret in practice will contain a plurality of combined orifices, one for each filament to be spun.

FIG. 2 illustrates the preferred method for generating a temperature difference between the two sub-streams. When a molten polymer is pumped through a resistance to fluid flow, most of the work performed is converted into heat. In the case of nylon-66 polymer having an R.V. of 45, metering the polymer at about 290° C. through a 70 Kg/cm$^2$ pressure drop will increase the polymer temperature by an amount of the order of magnitude of 2° C. As illustrated, passage 54 contains a narrowed portion for providing a higher resistance to fluid flow than is provided by passage 64. Accordingly the first polymer sub-stream fed into counterbore 56 and capillary 58 will be hotter than the second polymer sub-stream fed into counterbore 66 and capillary 68. Another technique for creating different resistances to fluid flow would be to eliminate plate 48 and provide different amounts or different types of filtration media in cavities 44 and 46.

Still referring to FIG. 2, according to the invention (and in contrast to the prior art), the sub-streams unite at a point lower than a plane 0.006 inch (0.15 mm) above the face 70 of spinneret 22. This reduces the time that the sub-streams are in contact with one another prior to quenching, and maintains the temperature difference of the sub-streams to a greater degree than if the sub-streams were earlier united as was done by the prior art.

Figure 3:
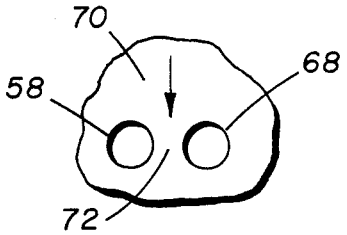
FIG. 3 is a bottom plan view of of one preferred spinneret according to the invention.
Figure 4:
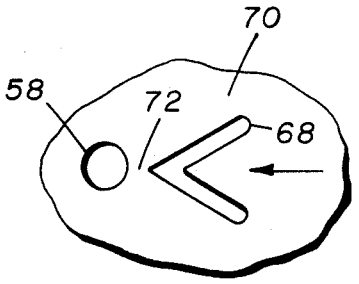
FIG. 4 is a bottom plan view of another preferred spinneret according to the invention.

This maintenance of the maximum temperature difference is maximized when the sub-streams merge side-by-side and unite below the face of spinneret 22, as illustrated in FIGS. 3 and 4.

The observed bulk in each of the following examples is due to differential quenching due to the transverse quenching air flow across the molten streams under the stress of high speed spinning.

EXAMPLE 1

This example illustrates that some minor degree of bulk is inherently induced in high speed spinning by transversely directed quenching air under the stress of high speed spinning, although not to a useful level unless the various spinning parameters are appropriately selected.

FIG. 3 shows one combined orifice on the face 70 of a preferred embodiment of spinneret 22. As illustrated, capillaries 58 and 68 do not intersect within the spinneret as in FIG. 2. Each capillary has a diameter of 0.46 mm and a length of 0.76 mm. The axes of the capillaries form an included angle of 60°, and the distance between the axes in the plane of the spinneret is 0.61 mm. That is, land 72 between capillaries 58 and 68 is about 0.15 mm. wide, and the two sub-streams unite and join side-by-side at a point below the face of spinneret 22 to form a combined stream. In this example spinneret 22 contains 10 combined orifices.

Nylon-66 sub-streams at a temperature of 295° C. upon entering cavities 44 and 46 are spun without a pressure plate, attempting to produce a minimum temperature difference between the first and second sub-streams. The polymer is selected such that the yarn has an RV of 53.5. Transversely directed quench air at room temperature is supplied in a quench zone 914 mm high at an average speed of 32.5 meters per minute from the direction indicated by the arrow in FIG. 3. The polymer metering rates are selected such that all sub-streams have the same flow rate and the resulting filaments have individual deniers of 10.5 at a spinning speed of 4572 MPM. With the pressure of cavity 44 at 2300 psig (162 kg/cm$^2$) and the pressure in cavity 46 at 2100 psig (148 kg/cm$^2$), which difference in pressure would generate very little temperature difference between the sub-streams in capillaries 58 and 68, the convergence and finish application guide 30 is located 55 inches (140 cm) below the spinneret.

The resulting yarn has an elongation of 73.5%, a tenacity of 1.6 grams/denier, a bulk of 9.7%, and a shrinkage of 3.5%. The yarn does not possess a useful degree of bulk, as indicated by a bulk value less than 10%.

EXAMPLE 2

Example 1 is repeated except the convergence guide is lowered to a point 150 inches (381 cm) below spinneret 22. The resulting yarn has an elongation of 71.5%, a tenacity of 1.5 grams/denier, a bulk of 9.5%, and a shrinkage of 3.1%.

The yarn does not possess a useful degree of bulk, as indicate by a bulk value less than 10%, despite the use of a convergence distance of 150 inches (381 cm). As will be shown below, increasing the convergence distance is normally effective in increasing yarn bulk if the other spinning parameters are properly selected.

EXAMPLE 3

Example 1 is repeated, except that pressure plate 48 is provided such that the pressure in cavity 44 is 6200 psig (436 kg/cm$^2$) and the pressure in cavity 46 is 2400 psig (169 kg/cm$^2$), which would generate several degrees temperature difference between the sub-streams in capillaries 58 and 68. When guide 30 is located 55 inches (140 cm) below spinneret 22, the yarn has an elongation of 71.8%, a tenacity of 1.65 grams/denier, a bulk of 12.9%, and a shrinkage of 3.3%.

The yarn bulk of 12.9% permits the yarn to be useful in various end uses, such as in carpets or upholstery. The yarn of this example illustrates that useful bulk can be achieved by the increased temperature difference across the molten stream being quenched according to the invention even when the quenching air is not supplied from the most favorable direction, which would be impinging on the cooler side of the combined stream, with the hot side of the combined stream shielded from the quench air by the cooler side. In this case, as in Examples 1 and 2, quenching air is equally supplied to the hot and cool sides of the yarn.

EXAMPLE 4

Example 3 is repeated, except that guide 30 is located at a point 150 inches (381 cm) below spinneret 22, providing a yarn having an elongation of 71.4%, a tenacity of 1.6%, a bulk of 17.8%, and a shrinkage of 3.7%.

This illustrates that, when the temperature difference across the molten stream is sufficient, bulk can be controlled by selecting the convergence distance, with bulk generally increasing with increasing convergence distance.

EXAMPLE 5

Other factors than a larger temperature difference across the molten stream, quench air direction and longer convergence distance are significant in providing increased bulk. Providing a larger surface area exposed to the quench air is one, as is a larger denier per filament. Experiment 4 is repeated, except that spinneret design of FIG. 4 is used, the yarn R.V. is 62, and the convergence distance is 115 inches (292 cm). Capillary 58 has a diameter of 0.022 inch (0.56 mm) and a length of about 0.020 inch (0.51 mm), while V-shaped capillary 68 has a slot width of 0.010 inch (0.25 mm) and an overall length in the direction of polymer flow of 0.046 inch (1.17 mm). The length of capillary 68 along the "V" in the plane of face 70 is 0.046 inch (1.17 mm). The axes of capillaries 58 and 68 are each inclined at an angle of 52° from the plane of face 70, such that the axes form an included angle of 76°. There is a land 72 0.003 inches (0.076 mm) wide between the capillaries on face 70.

The polymer metering rates are such that each of the 10 filaments spun by the spinneret has a denier of about 14.5 rather than the 10 in the previous examples, with a pack pressure of 4700 psig (331 kg/cm$^2$) for capillary 58 and a pack pressure of 6300 psig (444 kg/cm$^2$) for capillary 68. The direction of quench air is as shown in the drawing, with the air directed toward the "V".

The resulting yarn has a denier of 145, an elongation of 59.5%, a tenacity of 1.36 grams/denier, a bulk of 37%, and a shrinkage of 3.29%.

By overfeeding the yarn by 2.6% from roll 32 to roll 36 and supplying a tangle chamber mounted between the rolls with air heated to 300° C., the yarn becomes prebulked and has a denier of 149, an elongation of 56%, a tenacity of 1.09 grams/denier, a bulk of 54.8%, and a shrinkage of 4%.

EXAMPLE 6

It has been discovered that the quenching and hence the luster of yarn comprising filaments having large individual deniers can be improved in the case of nylon-66 by replacing between about 0.5 and 15 mol % adipic acid with terephthalic acid such that the resulting polymer contains between 0.5 and 15 mol % hexamethylene diammonium terephthalate moieties. Example 5 is repeated with nylon-66 polymer containing 5 mol % terephthalate moieties such that the yarn has 64 R.V. The spinning speed is 5000 YPM (4572 MPM), and the equal metering rates are such that the yarn has 149 denier. The resulting yarn has superior luster, an elongation of 61%, a tenacity of 1.5%, a bulk of 31%, and a shrinkage of 3.3%.

TEST METHODS

The yarn elongation-to-break is measured one week after spinning. All yarn packages to be tested are conditioned at 21 degrees C. and 65% relative humidity for one day prior to testing. Fifty yards of yarn are stripped from the bobbin and discarded. Elongation-to-break is determined using an Instron tensile testing instrument. The gage length (initial length) of yarn sample between clamps on the instrument) is 25 cm., and the crosshead speed is 30 cm. per minute. The yarn is extended until it breaks. Elongation-to-break is defined as the increase in sample length at the time of maximum load or force (stress) applied, expressed as a percentage of the original gage length (25 cm.).

Relative viscosity (R.V.) is determined by ASTM D789-81, using 90% formic acid.

As used in the specification and claims, the term "Nylon 66" shall means those synthetic polyamides containing in the polymer molecule at least 85% by weight of recurring structural units of the formula $$-\overset{\overset{\displaystyle O}{\|}}{C}-(CH_2)_4-\overset{\overset{\displaystyle O}{\|}}{C}-\overset{\overset{\displaystyle H}{|}}{N}-(CH_2)_6-\overset{\overset{\displaystyle H}{|}}{N}-$$

Bulk and shrinkage are determined by the following procedures. The yarn is conditioned at 23° C. and 72% relative humidity for one day prior to testing. Twenty five meters of yarn are stripped from the surface of the bobbin and discarded. Using a Suter denier reel or equivalent and a winding tension of 0.033 grams per yarn denier, the yarn is wound into a skein having a 1.125 meter circumference and a skein denier of approximately (but not to exceed) 55,000 skein denier. That is, if the yarn denier is 520, 52 revolutions of the denier reel will provide a skein denier of 54,080 while 53 revolutions would provide a skein denier of 55,120. In this instance 52 revolutions would be used. The ends of the skein are tied together while maintaining the 0.033 grams per denier tension, and the skein is removed from the denier reel and suspended from a ½ inch (12.7 mm) diameter rod. A number 1 paper clip, bent into an "S" shape is suspended from the skein. The rod with skein and paper clip attached is placed in a 180° C. forced hot air oven sufficiently large that the skein hangs freely. After 5 minutes in the oven, the rod with skein and paper clip is removed from the oven and hung in an atmosphere of 23° C. and 72% relative humidity for one minute. A weight equal to 0.0009 grams per skein denier is then gently suspended from the paper clip. After 30 seconds, the skein length in centimeters is measured to provide length La. The small weight is then replaced with a weight equal to 0.825 grams per skein denier. After 30 seconds, the skein length in centimeters is measured to provide length Lb. The percent bulk is then defined as (100)(56.25-La)/56.25, while the percent shrinkage is defined as (100)(56.25-Lb)/56.25.

What is claimed is:

1. A process for spinning a yarn having latent crimp, comprising:

(a) spinning a plurality of filaments, each of said filaments being formed by:

(1) generating first and second sub-streams of a molten polymer, and first sub-stream having a higher temperature than said second sub-stream;

(2) metering said sub-streams at given rates through separate passageways in a spinneret;

(3) said passageways being selected and arranged such that said sub-streams unite and merge side-by-side at a point below a plane 0.15 mm above the face of said spinneret to form a combined stream having a relatively cool side comprising said second sub-stream and a relatively hot side comprising said first sub-stream;

(4) directing quenching air against said combined stream below said spinneret from a given direction to thereby quench said combined stream into a filament, said given direction is selected so that said quench air preferentially impinges on said relatively cool side; and (5) withdrawing said filament from said combined stream at a spinning speed above 2500 MPM; and (b) converging from filaments at a given distance from said spinneret to form said yarn;

(c) said polymer, the temperature of said sub-streams, said metering rates, said given direction, and given distance, and said spinning speed being selected such that said filament has an elongation below 100% and a bulk of at least 10%.

2. The process defined in claim 1, wherein said first sub-stream is metered through a higher resistance to fluid flow than said second sub-stream prior to extrusion through said passageways.

3. The process defined in claim 1, wherein said passageway through which said second sub-stream is metered is selected such that said second sub-stream has a non-round cross-section just prior to merging with said first sub-stream.

4. The process defined in claim 1, wherein said metering rates and said spinning speed are selected such that said filament has a denier of at least 12.

5. The process defined in claim 1, wherein said passageways are selected and arranged such that said sub-streams merge below said face of said spinneret.

6. The process defined in claim 1, wherein said polymer is nylon-66.

7. The process defined in claim 6, wherein said polymer contains between 0.5 and 15 mol % hexamethylene diammonium terephthalate moieties.

8. The process defined in claim 5, wherein said passageway through which said second sub-stream is metered is selected such that said second sub-stream has a non-round cross-section prior to merging with said first sub-stream.

9. The process defined in claim 5, wherein said polymer is nylon-66.

10. The process defined in claim 9, wherein said polymer contains between 0.5 and 15 mol% hexamethylene diammonium terephthalate moieties.

* * * * *